US008133074B1

(12) United States Patent
Park et al.

(10) Patent No.: US 8,133,074 B1
(45) Date of Patent: Mar. 13, 2012

(54) GUIDED MISSILE/LAUNCHER TEST SET REPROGRAMMING INTERFACE ASSEMBLY J2 CONNECTOR CLAMP

(75) Inventors: Bruce J. Park, Camarillo, CA (US); Michael A. Torres, Newbury Park, CA (US); Mark A. Doty, Port Hueneme, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 44 days.

(21) Appl. No.: 12/824,839

(22) Filed: Jun. 28, 2010

(51) Int. Cl.
*H01R 13/66* (2006.01)

(52) U.S. Cl. ..... 439/574; 439/76.1

(58) Field of Classification Search ..... 439/76.1, 439/83, 571–575
See application file for complete search history.

(56) References Cited

U.S. PATENT DOCUMENTS 6,099,325 A * 8/2000 Parkhill ..... 439/76.1
6,511,328 B2 * 1/2003 Molus et al. ..... 439/76.1
6,581,791 B2 * 6/2003 Flint et al. ..... 213/1.3

* cited by examiner

*Primary Examiner* — Khiem Nguyen
(74) *Attorney, Agent, or Firm* — James M. Saunders

(57) ABSTRACT

A guided missile/launcher test set reprogramming interface assembly J2 connector clamp includes a frame having an upper side, a lower side, and at least one aperture with a threaded portion that extends through the frame and is adapted to threadingly associate with threads on a connector. Rotational torque is transferred away from the frame and connector when a securing mechanism is actuated.

13 Claims, 4 Drawing Sheets

GUIDED MISSILE/LAUNCHER TEST SET REPROGRAMMING INTERFACE ASSEMBLY J2 CONNECTOR CLAMP

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to clamps, and more particularly, to guided missile/launcher test set reprogramming interface assembly J2 connector clamps.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to clamps, and more particularly, to guided missile/launcher test set reprogramming interface assembly J2 connector clamps.

Clamps are used in a variety of applications in both civilian and military matters. Missile communication systems use connectors to relay commands to and from missiles and printed circuit boards by contact. However, the communication systems may fail because contact between the connector and printed circuit board may be degraded or eliminated entirely because rotational torque breaks the connection. Additionally, existing connectors are often used with dedicated flanges to connect to dedicated surfaces. However, the existing connectors cannot connect to other surfaces using their dedicated flanges. Because of this, it is desirous to find a guided missile/launcher test set reprogramming interface assembly J2 connector clamp.

Figure 3:
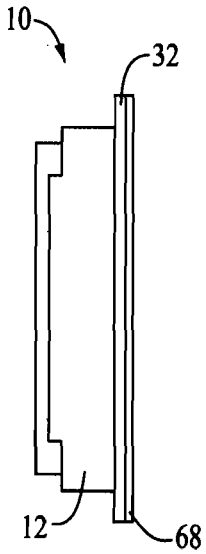
FIG. 3 illustrates an inverted side perspective view of the guided missile/launcher test set reprogramming interface assembly J2 connector clamp, shown with the gasket and gasket plate on an opposing side from a securing mechanism (not shown), according to embodiments of the invention.
Figure 1:
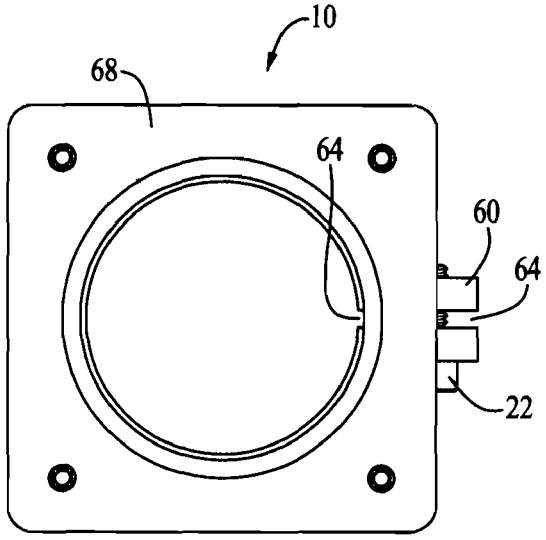
FIG. 1 illustrates a top perspective view of a guided missile/launcher test set reprogramming interface assembly J2 connector clamp with a gasket, gasket plate (not shown), and a securing mechanism, according to embodiments of the invention.
Figure 4:
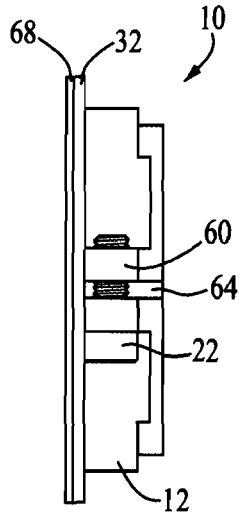
FIG. 4 illustrates an inverted side perspective view of a guided missile/launcher test set reprogramming interface assembly J2 connector clamp, shown with the gasket and gasket plate on the same side as a securing mechanism, according to embodiments of the invention.
Figure 2:
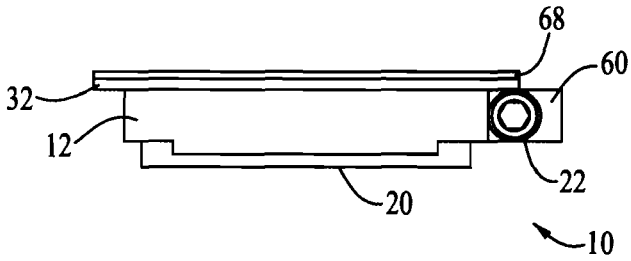
FIG. 2 illustrates a side perspective view of a guided missile/launcher test set reprogramming interface assembly J2 connector clamp, shown with the gasket and gasket plate on the same side as a securing mechanism, according to embodiments of the invention.
Figure 5:
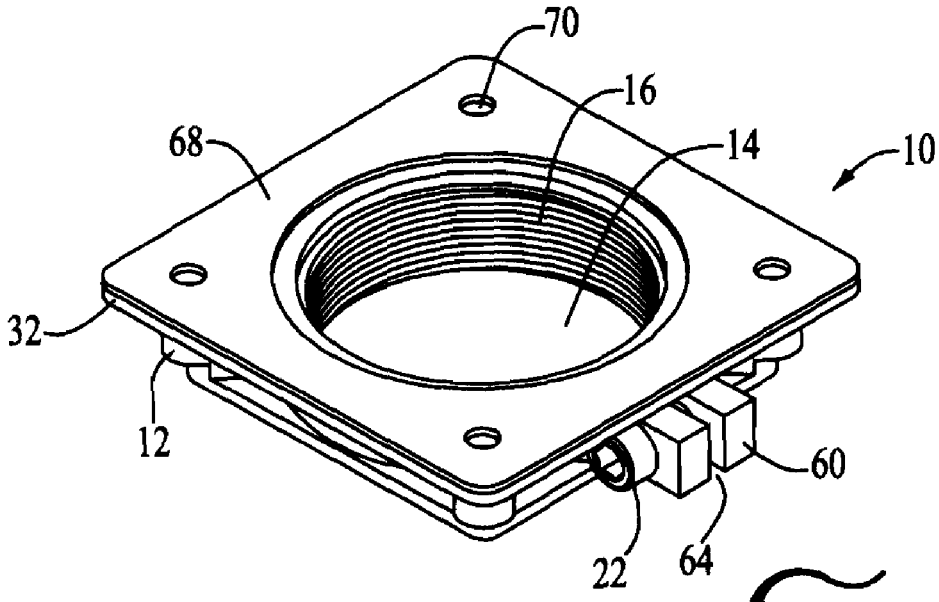
FIG. 5 illustrates an isometric top perspective view of a guided missile/launcher test set reprogramming interface assembly J2 connector clamp, shown with the gasket, gasket plate, and a securing mechanism, according to embodiments of the invention.

Referring to the accompanying drawings in which like reference numbers indicate like elements, FIG. 1 illustrates a first aspect of a guided missile/launcher test set reprogramming interface assembly J2 connector clamp. Reference character 10 generally indicates an apparatus of embodiments of the invention.

Figure 6:
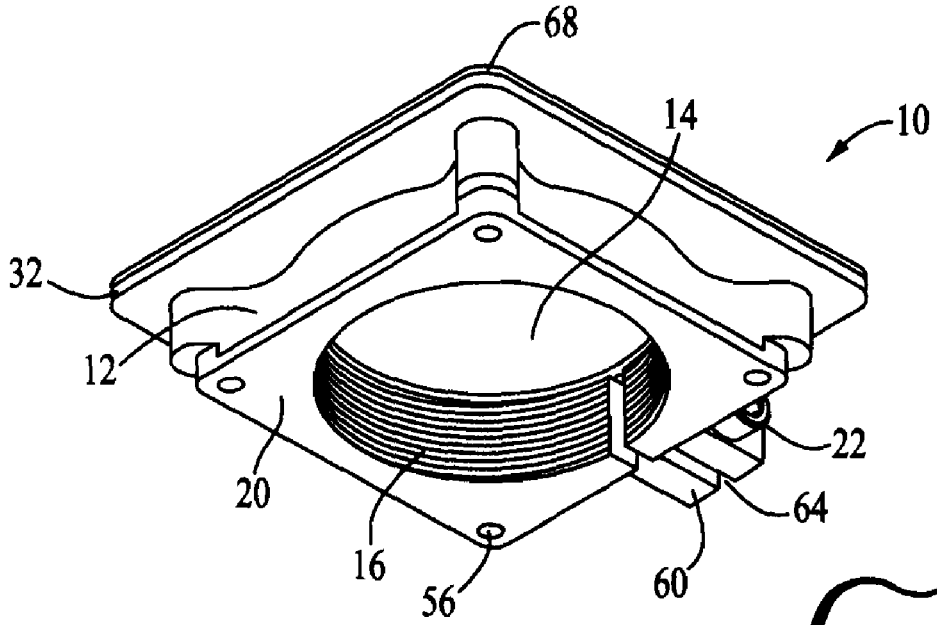
FIG. 6 illustrates an isometric bottom perspective view of a guided missile/launcher test set reprogramming interface assembly J2 connector clamp, shown with the gasket, gasket plate, and a securing mechanism, according to embodiments of the invention.
Figure 7:
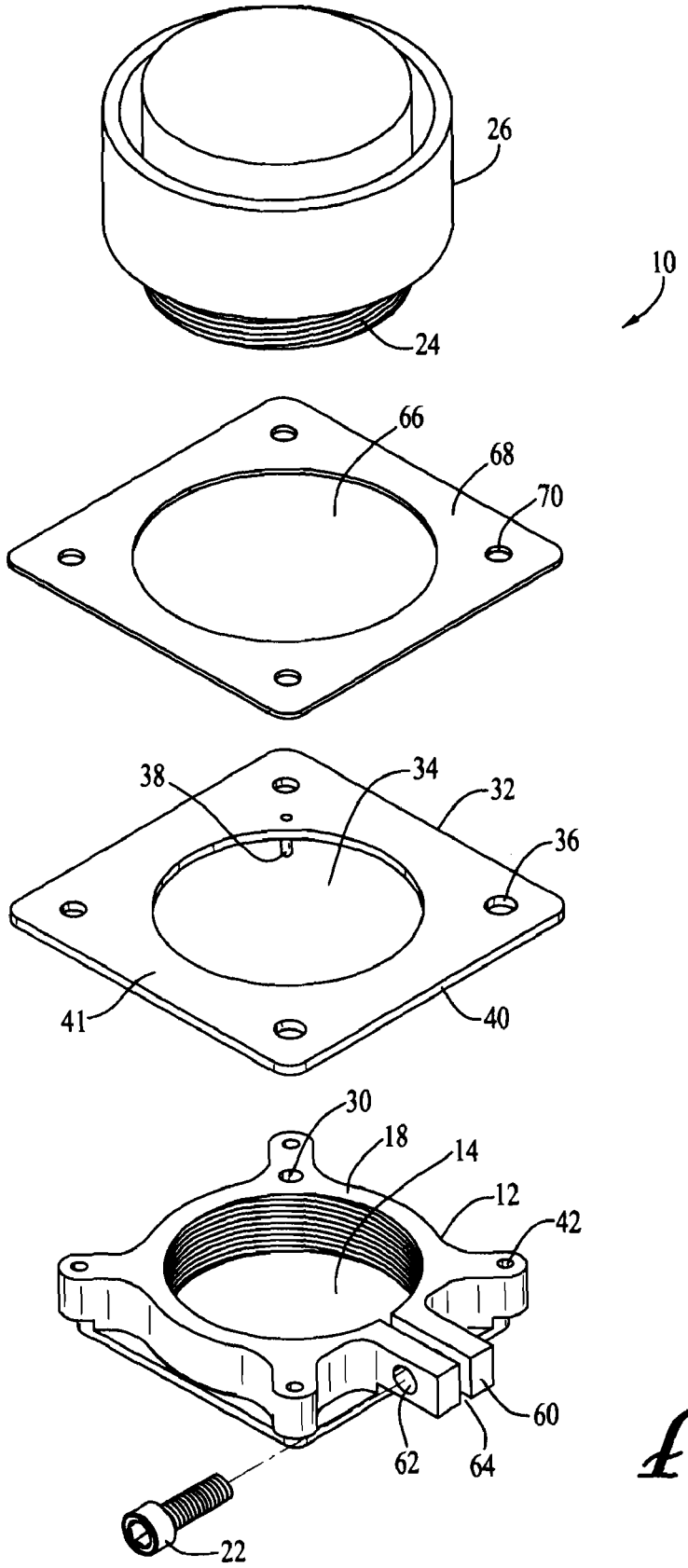
FIG. 7 illustrates an unassembled perspective view of a guided missile/launcher test set reprogramming interface assembly J2 connector clamp, shown with a connector, gasket, gasket plate, and a securing mechanism, according to embodiments of the invention.
Figure 8:
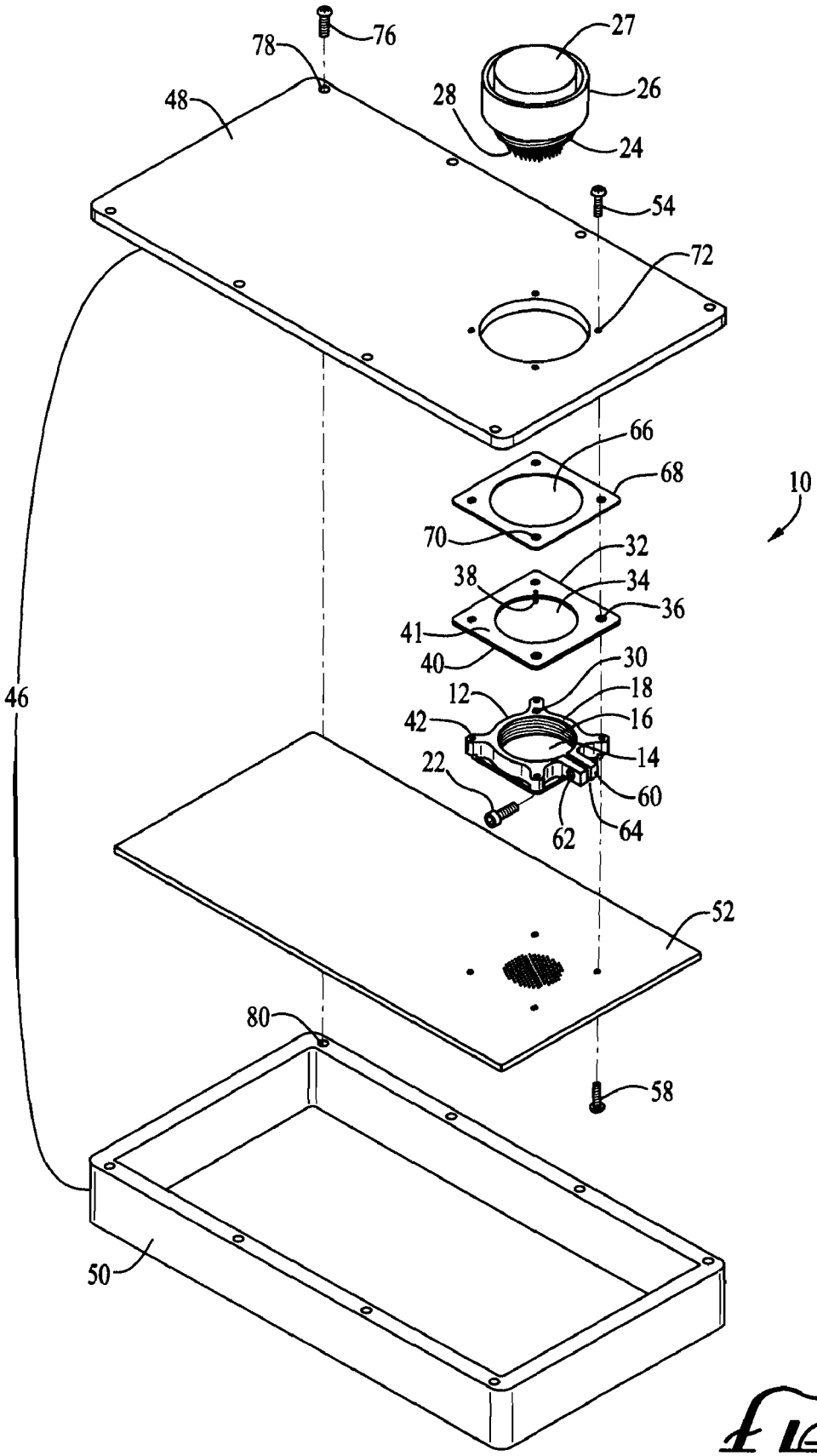
FIG. 8 illustrates an unassembled perspective view of a guided missile/launcher test set reprogramming interface assembly J2 connector clamp, shown with an upper and lower housing, a printed circuit board, the connector, gasket, gasket plate, and a securing mechanism, according to embodiments of the invention.

Referring simultaneously to FIGS. 2 through 8, the apparatus 10 has a frame 12. In an embodiment as shown in FIGS. 5 through 8, the frame 12 has at least one aperture 14. The aperture 14 is centrally located in the frame 12, extends through the entire frame, and has a threaded portion 16 (not shown in FIG. 7) that is adapted to threadingly associate with threads 24 on a connector 26 (shown in FIGS. 7 and 8). In another embodiment, the frame 12 is has an upper side 18 (shown in FIGS. 7 and 8), a lower side 20 (shown in FIG. 6), and at least one securing mechanism 22 (shown in FIGS. 1, 2, 4, 5, 6, 7, and 8). In another embodiment, the frame 12 is stainless steel and the securing mechanism 22 is a screw engaged with a dual-extrusion ribset 60 (shown in FIGS. 1, 2, 4, 5, 6, 7, and 8), and the dual-extrusion ribset has an associated threaded dual-cavity channels 62 (shown in FIGS. 7 and 8) that are appropriately dimensioned for threading engagement with the screw. FIGS. 5 through 8 show an interspace 64 exists from and between the dual-extrusion ribset 60 to the aperture 14 of the frame 12. As depicted in FIG. 8, when the securing mechanism 22 is engaged, rotational torque is transferred away from the frame 12 and a connector 26 having at least one extension 28.

FIGS. 7 and 8 show that the apparatus 10 has at least one guide well 30 through the upper side 18 of the frame 12. The guide well 30 provides for a pin-and-slot connection engagement with at least one gasket plate 32. Any number of guide wells and gasket plates may be used without detracting from the scope of the invention.

In an embodiment shown in FIGS. 7 and 8, the gasket plate 32 has a central aperture 34 extending through the gasket plate. Additionally, the gasket plate 32 has a plurality of holes 36 extending through the gasket plate. A pin 38 is on the lower side 40 of the gasket plate 32 and assists a user in completing the pin-and-slot connection engagement of the gasket plate 32 with the guide well 30 of the frame 12.

In embodiments shown in FIGS. 7 and 8, a plurality of threaded recesses 42 are located in the upper side 18 of the frame 12. FIG. 8 shows that the plurality of threaded recesses 42 are used to assist in fastening the frame 12 to a housing 46 having an upper portion 48 and a lower portion 50. In embodiments, the housing 46 is made of aluminum, rectangular in shape, and includes a printed circuit board 52 used for communicating with a missile. A plurality of screws 54 are appropriately dimensioned to fit with the plurality of threaded recesses 42 in the frame 12. Any number of screws or other fastening methods may be used to fasten the frame 12 to the housing 46.

FIG. 6 shows that a multitude of threaded recesses 56 are located in the lower side 20 of the frame 12. The multitude of threaded recesses 56 are used to assist in securing the frame 12 to the printed circuit board 52 (shown in FIG. 8). A plurality of screws 58 (shown in FIG. 8) are appropriately dimensioned to fit with the multitude of threaded recesses 56 (shown in FIG. 6) in the frame 12. Any number of screws or other fastening methods may also be used.

FIGS. 2, 4, 5, 6, 7, and 8 show that the securing mechanism 22 is located on a distal end of the frame 12. In this embodiment, the securing mechanism 22 is a screw. When engaged, the screw is actuated by the user by turning the screw with a wrench. The user supplies sufficient torque on the screw 22 required to restrain rotational torque on the connector 26 (shown in FIGS. 7 and 8), as determined by the user. The amount of torque applied to the screw 22 can be adjusted and varies depending on operational circumstances. The actuation causes both the interspace 64 between the dual-extrusion ribset 60 and the diameter of the aperture 14 of the frame 12 to be reduced. This reduction tightens the frame 12 around the connector 26 and assists with transferring rotational torque away from the connector and at least one extension 28 (shown in FIG. 8) of the connector, when complemented with tightening fastening mechanisms including the plurality of screws 54 and 58, and housing screws 76.

Referring to FIG. 8, another embodiment of the guided missile/launcher test set reprogramming interface assembly J2 connector clamp 10 is shown. At least one extension 28 of the connector 26 is at least one pin. In embodiments, a plurality of pins 28 are present and are capable of mating engagement with the printed circuit board 52. The pins 28 are capable of providing electrical communication connectivity for missile programming. The pins 28 extend through the entire length of the connector 26 and frame 12 and into the printed circuit board 52. The pins 28 are then matingly engaged with the printed circuit board 52 by passing the connector 26 and pins 28 through a gasket aperture 66 extending through a gasket 68. The connector 26 and pins 28 then pass through the central aperture 34 of the gasket plate 32. The mating engagement is completed by threading the connector threads 24 with the threaded portion 16 of the frame 12, which positions the pins 28 at a desired location and height in relation to the printed circuit board 52, thus allowing communication between the missile and printed circuit board. When the dual-extrusion ribset 60 is tightened by actuating the screw 22, rotational torque is transferred away from the frame 12, connector 26, and pins 28. Rotational torque is transferred to a stationary steel center piece 27 of the connector 26. The rotational torque then transfers to the housing 46. In embodiments, actuating the screw 22 maintains proper communication connectivity positioning between the pins 28 and printed circuit board 52. In other embodiments, the dual-extrusion ribset 60 is adjusted to accommodate many differently-sized connectors 26 that connect to many different surfaces by actuating the screw 22.

Another embodiment of the invention includes a method of connecting a guided missile/launcher test set reprogramming interface assembly connector 10 to a printed circuit board 52, that involves providing a frame 12 having an upper side 18, a lower side 20, at least one aperture 14 having a threaded portion 16 where the at least one aperture is centrally located in the frame. The aperture 14 extends through the frame 12 and is adapted to threadingly associate with threads 24 on a guided missile/launcher test set reprogramming interface assembly connector 26 having at least one extension 28. The at least one extension 28 is at least one pin capable of mating engagement with a printed circuit board 52. The upper side 18 of the frame 12 has at least one guide well 30 and a plurality of threaded recesses 42 used to fasten the frame to an upper portion 48 of a housing 46 including a printed circuit board 52. The lower side 20 of the frame 12 has a multitude of threaded recesses 56 used to secure the printed circuit board 52 to the frame.

At least one securing mechanism 22 is provided and located on a distal end of the frame 12. The securing mechanism 22 has a dual-extrusion ribset 60. The dual-extrusion ribset 60 has an associated threaded dual-cavity channels 62, a screw dimensioned to provide for threading engagement with the dual-cavity channels to transfer rotational torque away from the frame 12, and the guided missile/launcher test set reprogramming interface assembly connector 10 having at least one extension 28.

One skilled in the art will recognize that the method of using the invention can be performed by an individual or automated such as, for example, with a machine. A user aligns the upper side 18 of the frame 12 with at least one gasket plate 32. At least one gasket plate 32 has a central aperture 14 extending through at least one gasket plate. At least one gasket plate 32 has a plurality of holes 36 to facilitate attachment to the frame 12.

The user connects the upper side 18 of the frame 12 with at least one gasket plate 32 by mating at least one guide well 30 of the frame 12 with a pin 38 on a lower side 40 of the at least one gasket plate, and rests the lower side of the at least one gasket plate on the upper side of the frame. At least one guide well 30 and the pin 38 then form a pin-and-slot connection engagement for aligning the frame 12 with the gasket plate 32.

The user aligns an upper side 41 of the at least one gasket plate 32 with at least one gasket 68. At least one gasket 68 is dimensioned to adhere to the upper side 41 of at least one gasket plate 32. At least one gasket 68 has a central aperture 66 extending through the at least one gasket. The at least one gasket 68 has a plurality of holes 70 to facilitate attachment to the at least one gasket plate 32, and resting the at least one gasket on the upper side 41 of the at least one gasket plate.

The user applies a connection adhesive to the threads 24 on the guided missile/launcher test set reprogramming interface assembly connector 26.

The user inserts the threads 24 on the guided missile/launcher test set reprogramming interface assembly connector 26 into the frame 12 by inserting the guided missile/launcher test set reprogramming interface assembly connector through at least one gasket 68 having the central aperture 66, through the central aperture 34 of at least one gasket plate 32, and through at least one aperture 14 of the frame 12.

The user secures the upper portion 48 of the housing 46 including the printed circuit board 52 to the frame 12 by aligning a plurality of holes 72 of the upper portion 48 of the housing 46 with the plurality of holes 70 of at least one gasket 68, inserting a plurality of upper screws 54 through the plurality of holes 72 of said housing 46, through the plurality of holes 70 of the at least one gasket 68, through the plurality of holes 36 of at least one gasket plate 32, and through the plurality of threaded recesses 42 of the frame 12. In another embodiment, the number of plurality of holes 70 and number of plurality of upper screws 54 is four.

The user rotates the plurality of upper screws 54, where the upper portion 48 of the housing 46 is tightened to at least one gasket 68, where at least one gasket is tightened to at least one gasket plate 32, and where at least one gasket plate is tightened to the frame 12.

The user secures the printed circuit board 52 to the frame 12 by inserting the plurality of screws 58, which are appropriately dimensioned for the multitude of threaded recesses 56, through the printed circuit board and into the multitude of threaded recesses. The user then rotates the plurality of screws 58 to secure the printed circuit board 52 to the frame 12.

The user rotates the guided missile/launcher test set reprogramming interface assembly connector 26, where the guided missile/launcher test set reprogramming interface assembly connector is tightened to the frame 12. Hand or mechanical tightening is sufficient to secure the guided missile/launcher test set reprogramming interface assembly connector 26 to the frame 12.

The user actuates at least one securing mechanism 22 by turning the screw, which reduces the diameter of at least one aperture 14 of the frame 12. The diameter reduction tightens the dual-extrusion ribset 60 and transfers rotational torque away from at least one extension 28 to the housing 46.

The user secures the upper portion 48 of the housing 46 including a printed circuit board 52 to the lower portion 50 of the housing by aligning the lower housing recesses 80 with upper housing holes 78, inserting housing screws 76 through the upper housing holes and into the lower housing recesses. The housing screws 76 are appropriately dimensioned for both the upper housing holes 78 and lower housing recesses 80. Both the upper housing holes 78 and lower housing recesses 80 are appropriately threaded to accommodate the housing screws 76. The user then rotates the housing screws 76 to tighten the upper portion 48 of the housing 46 to the lower portion of the housing 50.

Major advantages of the invention include, but are not limited to several aspects important to maintaining proper missile communication connectivity. The invention prevents rotation of the connector 26 and eliminates strain on the pins 28. Additionally, the invention allows for adjustment for proper pin insertion height and alignment with the printed circuit board 52. After pin alignment, the connector 26 is locked into position with the printed circuit board 52 and housing 46 which prevents damage to the pins 28 because excess rotational torque is transferred to the housing.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A clamp, comprising:

a frame having an upper side, a lower side, at least one aperture having a threaded portion, and at least one securing mechanism;

wherein said at least one aperture extends through said frame and is adapted to threadingly associate with threads on a connector; and wherein when said at least one securing mechanism is actuated, rotational torque is transferred away from said frame and a connector having at least one extension.

2. The clamp according to claim 1, wherein said at least one aperture is centrally located in said frame.

3. The clamp according to claim 1, further comprising at least one guide well through said upper side of said frame and at least one gasket plate, wherein said at least one guide well provides for pin-and-slot connection engagement with said at least one gasket plate.

4. The clamp according to claim 1, further comprising a plurality of threaded recesses in said upper side of said frame, said plurality of threaded recesses fasten said frame to an upper portion of a housing including a printed circuit board by a plurality of screws appropriately dimensioned to receive said plurality of threaded recesses.

5. The clamp according to claim 4, wherein said frame further comprises a multitude of threaded recesses in said lower side of said frame, said multitude of threaded recesses secure said printed circuit board to said frame by a plurality of screws appropriately dimensioned to receive said multitude of threaded recesses.

6. The clamp according to claim 5, wherein said upper portion of said housing including said printed circuit board further comprises upper housing holes, said upper housing holes secure said upper portion of said housing to a lower portion of said housing by housing screws, said housing screws being appropriately dimensioned to receive lower housing recesses in said lower housing.

7. The clamp according to claim 1, wherein said at least one securing mechanism is located on a distal end of said frame, wherein said at least one securing mechanism is further comprised of a dual-extrusion ribset, said dual-extrusion ribset having an associated threaded dual-cavity channels capable of threading engagement with a screw.

8. The clamp according to claim 7, wherein said at least one securing mechanism is actuated by turning said screw, wherein reducing the diameter of said at least one aperture, wherein tightening said dual-extrusion ribset and transferring said rotational torque from said at least one extension to a housing.

9. The clamp according to claim 1, wherein said at least one extension is at least one pin capable of mating engagement with a printed circuit board.

10. The clamp according to claim 8, wherein said at least one extension being pin(s) and being capable of providing communication connectivity for missile programming, wherein said dual-extrusion ribset is tightened by actuating said screw and rotational torque is transferred away from said at least one extension, wherein said pin(s) maintain said mating engagement with a printed circuit board.

11. The clamp according to claim 10, wherein said pin(s) maintain proper communication connectivity positioning with said printed circuit board when said dual-extrusion ribset is tightened by actuating said screw(s).

12. A connector clamp, comprising:

a frame having an upper side, a lower side, at least one aperture having a threaded portion, and at least one securing mechanism;

at least one connector, each said connector having a threaded portion and at least one extension;

wherein said at least one aperture extends through said frame, wherein each said aperture having a threaded portion being adapted to threadingly associate with threads on each corresponding connector, wherein each said extension of each corresponding connector extends out of said lower side when mated; and wherein said at least one securing mechanism is actuated, rotational torque is transferred away from each said extension.

13. The connector clamp according to claim 12, wherein said at least one aperture is centrally located and extends through said frame.

* * * * *